US005520317A

United States Patent [19]

Eckert et al.

[11] Patent Number: 5,520,317

[45] Date of Patent: May 28, 1996

[54] TURNING BAR WITH SELECTIVELY OPENABLE AIR DISCHARGE OPENINGS

[75] Inventors: Günther O. Eckert, Zellingen; Heinrich K. Grosshauser, Würzburg, both of Germany

[73] Assignee: Koenig & Bauer Aktiengesellschaft, Wurzburg, Germany

[21] Appl. No.: 223,450

[22] Filed: Apr. 5, 1994

[30] Foreign Application Priority Data

Apr. 7, 1993 [DE] Germany ..... 43 11 438.5

[51] Int. Cl.[6] ..... B65H 23/32

[52] U.S. Cl. ..... 226/197; 226/199; 226/97

[58] Field of Search ..... 226/197, 198, 226/199, 97, 194; 137/868, 881; 251/321

[56] References Cited

U.S. PATENT DOCUMENTS

| | | | |
|---|---|---|---|
| 4,296,773 | 10/1981 | Harshman et al. | 137/868 X |
| 4,342,335 | 8/1982 | Reinicker et al. | 137/868 X |
| 4,453,465 | 6/1984 | Heller et al. | 226/97 X |
| 5,016,801 | 5/1991 | Gilat et al. | 226/199 X |
| 5,100,117 | 3/1992 | Hajek et al. | 226/197 X |
| 5,233,919 | 8/1993 | Fecteau et al. | 226/197 X |
| 5,273,201 | 12/1993 | Hambrecht | 226/197 |
| 5,316,199 | 5/1994 | Hansen et al. | 226/199 X |
| 5,357,859 | 10/1994 | Eckert | 101/228 |

FOREIGN PATENT DOCUMENTS

| | | |
|---|---|---|
| 0092658 | 11/1983 | European Pat. Off. . |
| 1072080 | 12/1959 | Germany . |
| 2101228 | 10/1984 | Germany . |
| 3127872 | 11/1985 | Germany . |
| 4117094 | 12/1992 | Germany . |
| 2256188 | 12/1992 | United Kingdom . |

*Primary Examiner*—Lenard A. Footland
*Assistant Examiner*—Thomas E. Dunn
*Attorney, Agent, or Firm*—Jones, Tullar & Cooper

[57] ABSTRACT

An adjustable turning bar for a material web is provided with an adjustably positionable tube that has a plurality of compressed air discharge openings. A slide tube is disposed within the turning bar tube and is also provided with a plurality of air openings. The slide tube is shiftable axially within the turning bar tube to align selected ones of the slide tube's air openings with the appropriate compressed air discharge openings on the turning bar. Air openings not being used will be closed off.

6 Claims, 7 Drawing Sheets

FIG.5
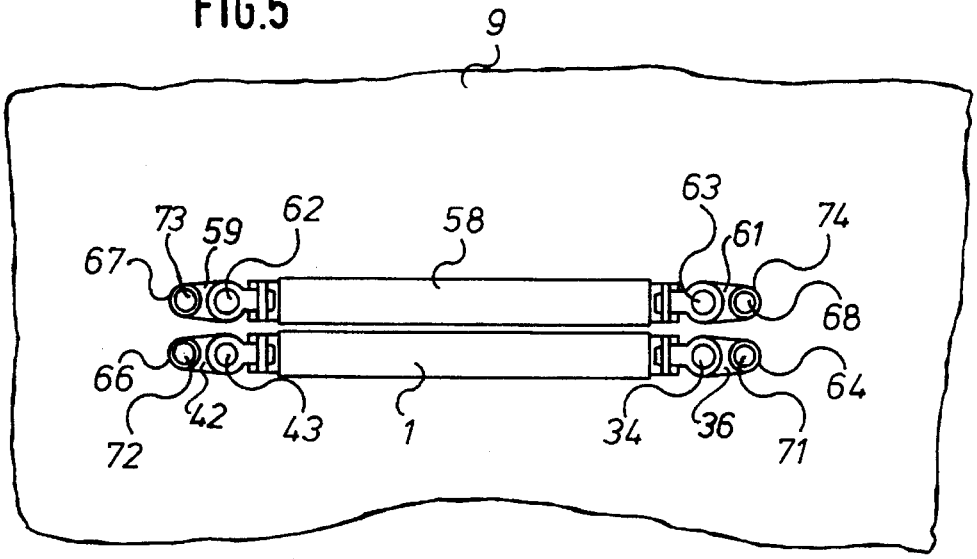
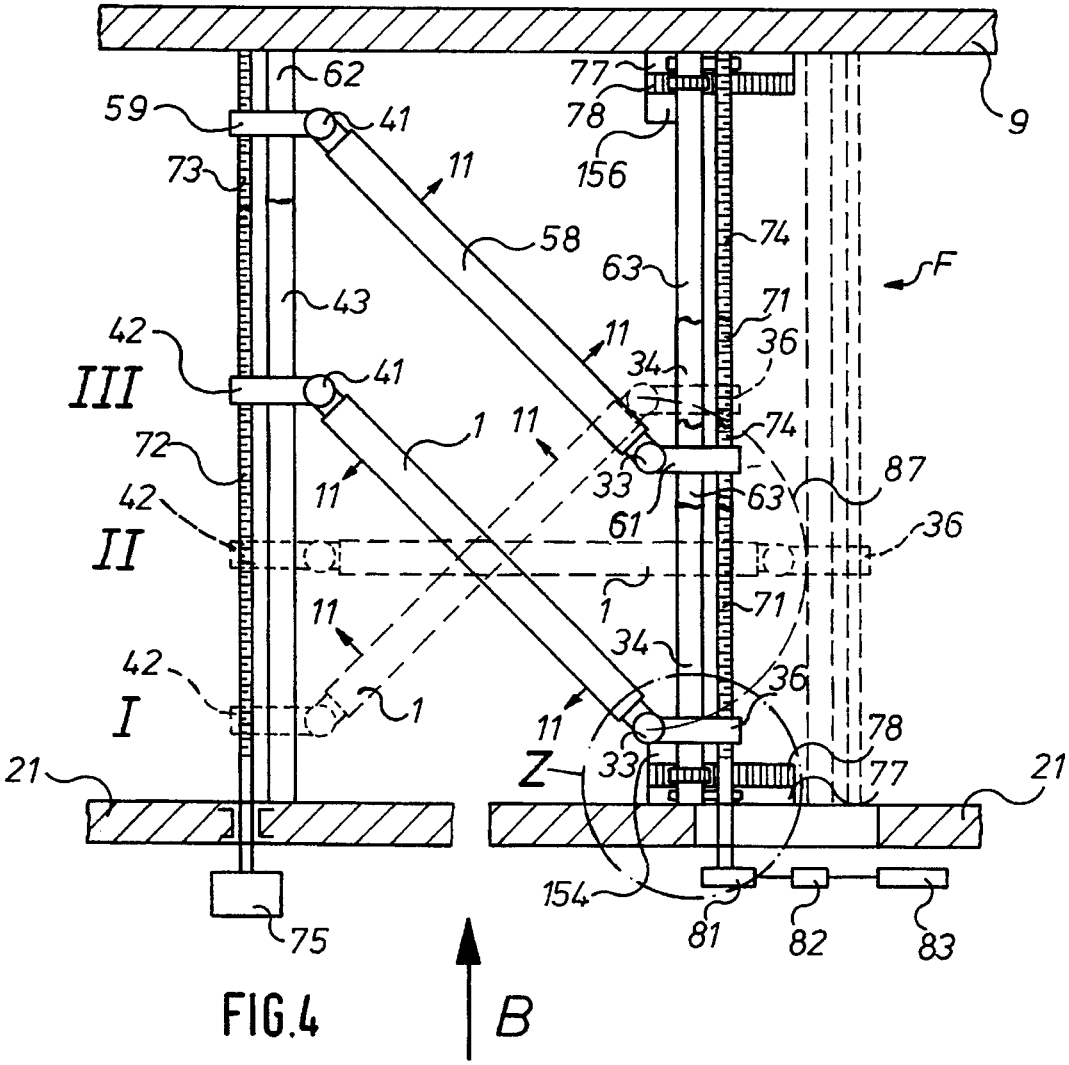
FIG.4

II
3a
4a
5a

TURNING BAR WITH SELECTIVELY OPENABLE AIR DISCHARGE OPENINGS

FIELD OF THE INVENTION

The present invention is directed generally to an adjustable turning bar for a web of material. More particularly, the present invention is directed to an adjustable turning bar for a paper web. Most specifically, the present invention is directed to an adjustable turning bar which is adjustably supported at its ends and which is provided with selectively openable air discharge openings. Joints for changing the position of the adjustable turning bar are provided at the ends of the turning bar and compressed air is supplied in an axial direction at one end of the turning bar. This compressed air is then exhausted outwardly in a radial direction through air openings provided in a surface area of the turning bar. The compressed air acts as an air bearing and reduces the friction between the paper web and the surface area of the adjustable turning bar. Positioning of the adjustable turning bar selectively opens or closes various ones of the air discharge openings.

DESCRIPTION OF THE PRIOR ART

A prior turning bar carriage for turning a paper web, has a carriage part displaceably disposed on two parallel guide spindles, at the end of which a transverse support is disposed in an L-shape. A turning bar, which can be repositioned, is fastened at the ends of the carriage part and the transverse support on swivel joints. This prior turning bar is shown in German Patent Publication DE 31 27 872 C2. In this case, compressed air is supplied to the turning bar via an opening by means of a telescoping tube. This air flows against the paper web out of openings disposed on the circumference of the turning bar.

A limitation of this prior device for repositioning or rearranging a turning bar lies in the fact that a portion of the air outlet openings, disposed on the circumference of the turning bar and utilized when the turning bar is in one position for paper web guidance, are no longer needed in another position of a turning bar in which the paper web arrives from another direction, for example displaced by 180°. These now unneeded air outlets must therefore be closed in order to prevent compressed air from escaping.

SUMMARY OF THE INVENTION

It is an object of the present invention to provide an adjustable turning bar.

Another object of the present invention is to provide an adjustable turning bar for a web of material.

A further object of the present invention is to provide an adjustable turning bar for a paper web.

Still another object of the present invention is to provide an adjustable turning bar having air outlet openings.

Yet a further object of the present invention is to provide an adjustable turning bar for a paper web in which unused air outlet openings can be closed.

As will be set forth in detail in the description of the preferred embodiments, which is presented subsequently, the adjustable turning bar in accordance with the present invention is used in guiding and turning a web of material and, in particular, a paper web. The turning bar is connected at its ends by joints to support frames so that it can be adjusted. Air under pressure is supplied to one end of the turning bar and travels axially through the interior of the hollow, generally tubular turning bar. This air exhausts radially outwardly through air openings that are placed in the turning bar. A slidable tube, that also has axially spaced air outlet openings, is carried within the tubular turning bar. This slidable tube can be shifted axially through a distance that is at least as great as the diameter of the individual air openings. The air openings in the turning bar and in the inner slidable tube are arranged with respect to each other such that sliding movement of the slide tube in the bore of the turning bar will cause selected air outlet openings around the periphery of the turning bar to be aligned with air outlet openings in the slide tube. This allows the selection of the appropriate air outlet openings on the turning bar to be aligned with the air outlet openings on the slide tube. This, in turn, provides air under pressure to the appropriate portion of the turning bar in response to the direction of paper web travel. Once a paper web guide is changed, and thus after the turning bars have been pivoted, the air outlet openings, which are now located outside of the path of travel of the paper web on the surface area of the turning bars and thus are not needed, are automatically closed solely by the one-sided pivoting of the turning bar over an angle of 90°. No additional effort to accomplish this is needed. In a further exemplary embodiment, it is possible, to close the unneeded air outlet openings with minimal effort independently of the respective position of the turning bar. This also applies to paper webs which are a quarter of the turning bar wide.

The adjustable turning bar in accordance with the present invention overcomes the limitations of the prior art devices. It is a substantial advance in the art.

BRIEF DESCRIPTION OF THE DRAWINGS

While the novel features of the adjustable turning bar in accordance with the present invention are set forth with particularity in the appended claims, a full and complete understanding of the invention may be had by referring to the detailed description of the preferred embodiments which is set forth subsequently, and as illustrated in the accompanying drawings, in which:

FIG. 4 is a schematic top plan view showing the repositioning of an adjustable turning bar;

FIG. 5 is a side elevation view taken in the direction of arrow B in FIG. 4;

DESCRIPTION OF THE PREFERRED EMBODIMENTS

Figure 1:
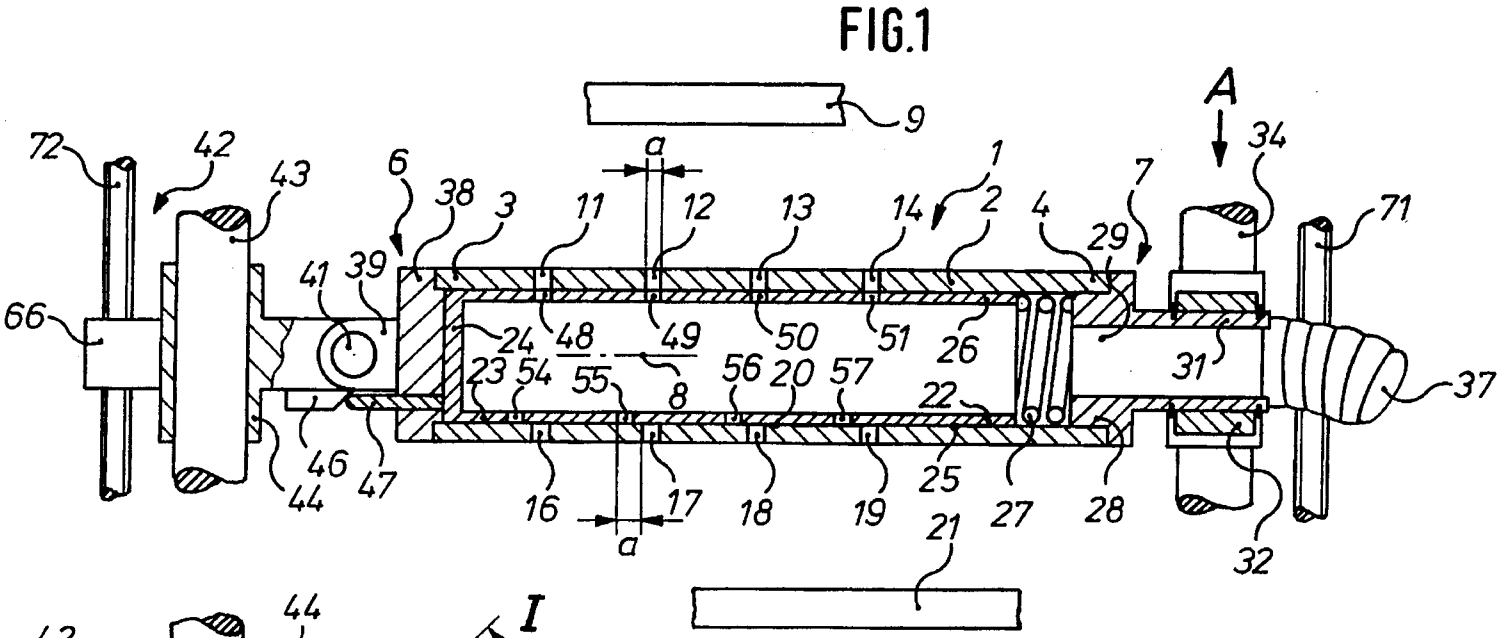
FIG. 1 is a longitudinal cross-sectional view of a first preferred embodiment of an adjustable turning bar in accordance with the present invention.

Referring initially to FIG. 1, there may be seen, generally at 1, a first preferred embodiment of an adjustable turning bar for a paper web in accordance with the present invention. In the illustration of FIG. 1, which shows a longitudinal section through a turning bar in accordance with the invention, and which is indicated by 1 as a whole, there is shown a top view of a turning bar frame located in front of an inlet for a folding apparatus of a web-fed rotary printing press. The turning bar 1 consists of a turning bar tube 2 which is closed on both first and second tube ends 3 and 4 respectively by end pieces 6 and 7 which are secured to the tube in a force-locking and form-locking manner. Over its surface area, the tube 2 has a plurality of air openings, which extend outwardly through the tube from a central axis of rotation 8 in a radial direction. The air openings shown in FIG. 1, facing a first schematically depicted side frame 9, are identified as 11, 12, 13 and 14. Additional air openings 16, 17, 18 and 19 are provided in the tube 2, and face a second schematically depicted side frame 21. The various air openings 11 to 14 and 16 to 19 in the turning bar tube 2 can be provided as bores, each having a diameter "a".

Figure 3:
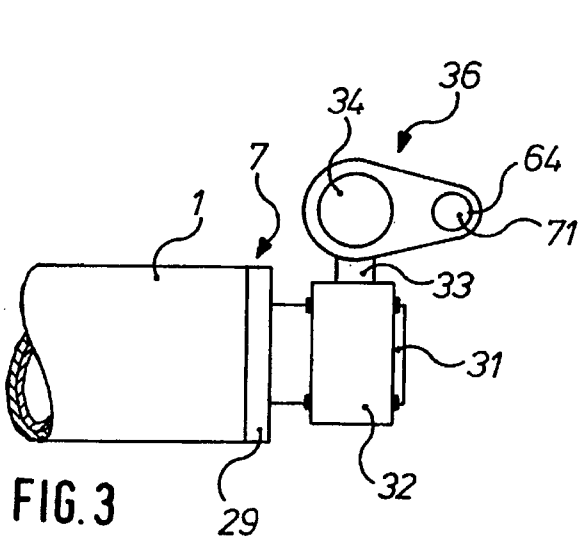
FIG. 3 is a top plan view of a portion of the adjustable turning bar taken in the direction of arrow A of FIG. 1.

A generally cup-shaped tubular slide 22, which can be displaced by an amount "a" in the direction of the axis of rotation of tube 8, is disposed in the interior of the tube 2. The exterior diameter of the slide 22 is of such a size that the slide 22 slides with its exterior surface area 20 along an interior surface area 25 of the tube 2 in a slightly adhering manner. This means that a slight frictional resistance must be overcome when the slide 22 is actuated inside the tube 2. On its first end 23, the slide 22 has a bottom 24, which can rest against the first end piece 6 of tube 2. A second, open end 26 of the slide 22 contacts, with its annular-shaped mouth, the outer turn of a compression spring 27. The second end of the compression spring 27 rests against the second end piece 7 of tube 2. A circumferential wall 28 of the second end piece 7 is configured to cooperate with the interior and exterior diameters of the tube 2. An axial air feed port 29 is formed in the end piece 7 in the vicinity of the axis of rotation 8, and extends in the direction away from the turning bar and can be designed as a bore. An axially extending second end 31 of the end piece 7 is enclosed by a holder 32 in a force-locking and form-locking manner. The holder 32 is, in turn connected in a force-locking and form-locking manner by means of a swivel joint 33 with a turning bar holder 36, which is displaceable on a support spindle 34, as seen in FIGS. 1 and 3. For greater clarity, no air openings are shown on the turning bar 1 in FIG. 3. The air feed 29 is connected with a compressed air source, not shown, via a hose 37.

Figure 2:
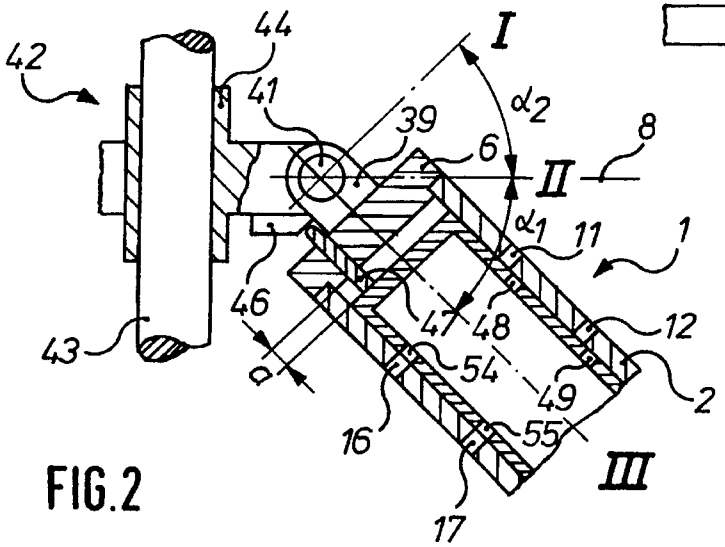
FIG. 2 is a cross-sectional view of one end of the adjustable turning bar of FIG. 1 and turned in a different direction.

A first end 38 of the first end piece 6 is adapted to the interior and exterior diameter of the tube 2. A second end 39 of end piece 6 extends in a direction away from the turning bar 1 and is connected in a force-locking and form-locking manner by a swivel joint 41 to a turning bar holder 42 having a profiled section which is formed approximately T-shaped and which, in turn, is displaceable on a support spindle 43. The turning bar holder 42 has, on a side of the cross arm part 44 of the T-shaped turning bar holder 42 facing the swivel joint 41 and also facing the side frame 21, a control cam 46 which is disposed in a force-locking and form-locking manner and which acts against a bolt or cam follower 47. The bolt 47 is disposed in a force-locking and form-locking manner concentrically to the axis of rotation 8 on the bottom 24 of the slide 22 and extends laterally next to the swivel joint 41 through a bore in the first end 38 of the first end piece 6. The end of the control cam 46 facing the bolt or cam follower 47 can be inclined at a 45° angle with respect to a paraxial horizontal line 8, so that an axial displacement of the slide 22 against the force of the compression spring 27 only takes place when the turning bar 1 is pivoted around the swivel joint 41 over a pivot angle $\alpha_1$ of 45° between the axis of rotation 8 and the lateral frame 21, as seen in FIG. 2.

The slide 22 has a number of air openings, which are designated by 48, 49, 50 and 51 on the side of the turning bar 1 facing the side frame 9, and by 54, 55, 56 and 57 on the side of the turning bar 1 facing the side frame 21. The number of the air openings 11 to 14 and 16 to 19 disposed in the tube 2 corresponds to the number of air openings 48 to 51 and 54 to 57 disposed in the slide 22. The air openings 48 to 51 and 54 to 57 can also be circular and have a diameter "a".

Turning now to FIGS. 1 and 4, when the turning bar assembly 1 is in either of positions I or II, the bottom 24 of the slide 22 rests against the inside of the first end of the end piece 6. In position I, the turning bar is at an angle $\alpha_2$ of 45° with respect to the axis of rotation 8 and the side frame 9. The bottom 22 also rests against the inside of the first end of the end piece 6 in the position II of the turning bar 1 in which the turning bar is aligned in the direction of the axis of rotation 8 as seen in FIG. 1. In this case, the air openings 11, 12, 13 and 14 of the tube 2 which are facing the side frame 9 are congruent with the air openings 48, 49, 50 and 51 of the slide 22. As a result, the air supplied to the interior of the turning bar 1 through the hose 37 and the air feed 29 can escape through the aligned air openings 11–14 and 48–51. A paper web, not shown, is supported by the compressed air exiting through the openings 11, 48; 12, 49; 13, 50 and 14, 51 which are charged with compressed air, as it is turned by the turning bar 1. The air openings 16 to 19 of tube 2 and 54 to 57 of slide 22 of the turning bar 1, which are disposed on the side facing the side frame 21 and which are not enclosed by the paper web, are closed so that no compressed air can escape. In the position III, shown in FIGS. 2 and 4, the turning bar 1 is pivoted around the swivel joint 41 at an angle $\alpha_1$ plus $\alpha_2$ of 90°. The slide 22 is displaced by an amount "a" in the direction toward the turning bar holder 36 by the action of the cam 46 on the bolt 47 or cam follower, so that the air openings discussed above in connection with the positions I and II are closed. Now the air openings 16–19 are opened, so that a paper web, not shown, is guided around the aforesaid air openings of the turning bar 1 and in this way an air cushion is generated between the paper web and the turning bar 1. The part of the turning bar 1, which is not enclosed by the paper web and which is oriented in the direction toward the side frame 9, does not allow compressed air to escape through the air openings 11–14 and 48–51, which are now offset with respect to each other. This is accomplished since the air openings 48 to 51 of the slide 22 on the side of the turning bar 1 facing the side frame 9 are not aligned with the air openings 54 to 57 of the slide 22 on the side of the turning bar 1 facing the side frame 21. Instead, they are offset by an amount "a", so that only the air openings 48, 11; 49, 12; 50, 13; and 51, 14 or the air openings 54, 16; 55, 17; 56, 18; and 57, 19 are aligned. However, the air openings 11 to 14 as well as 16 to 19 of the tube 2 respectively are aligned with each other.

A rearrangement procedure for a turning bar 1 in accordance with the present invention is schematically illustrated in FIG. 4. To simplify the illustration of the rearrangement procedure, the illustration of the longitudinal guides and drives for the turning bars has been omitted here. FIG. 5 shows the disposition of this and a further turning bar in a lateral view. The turning bar 1 with its turning bar holders 42, 36 is shown in position III, i.e. the air outlet openings not shown here are opened in the direction toward the side frame 21. In this position, the direction of a paper web of half width, not shown, which is arriving from the direction of the support spindle 43, is changed by 90° at the upper side of the turning bar frame which is close to the side frame 9 by means of a turning bar 58 disposed at an angle of 45° in relation to the side frames 9, 21. It is then guided in the direction toward the side frame 21, its direction is again changed by 90° by means of the turning bar 1 and the paper web is moved out of the turning bar frame in the direction toward the support spindle 34 at the lower side which is close to the side frame 21. The result is that the path of travel of the not shown paper web has been laterally shifted from an initial path of travel adjacent to the side frame 9 to a shifted path of travel adjacent the side frame 21. It is understood that the air openings pointing in the direction toward the side frame 9 are opened in the turning bar 58.

Figure 6:
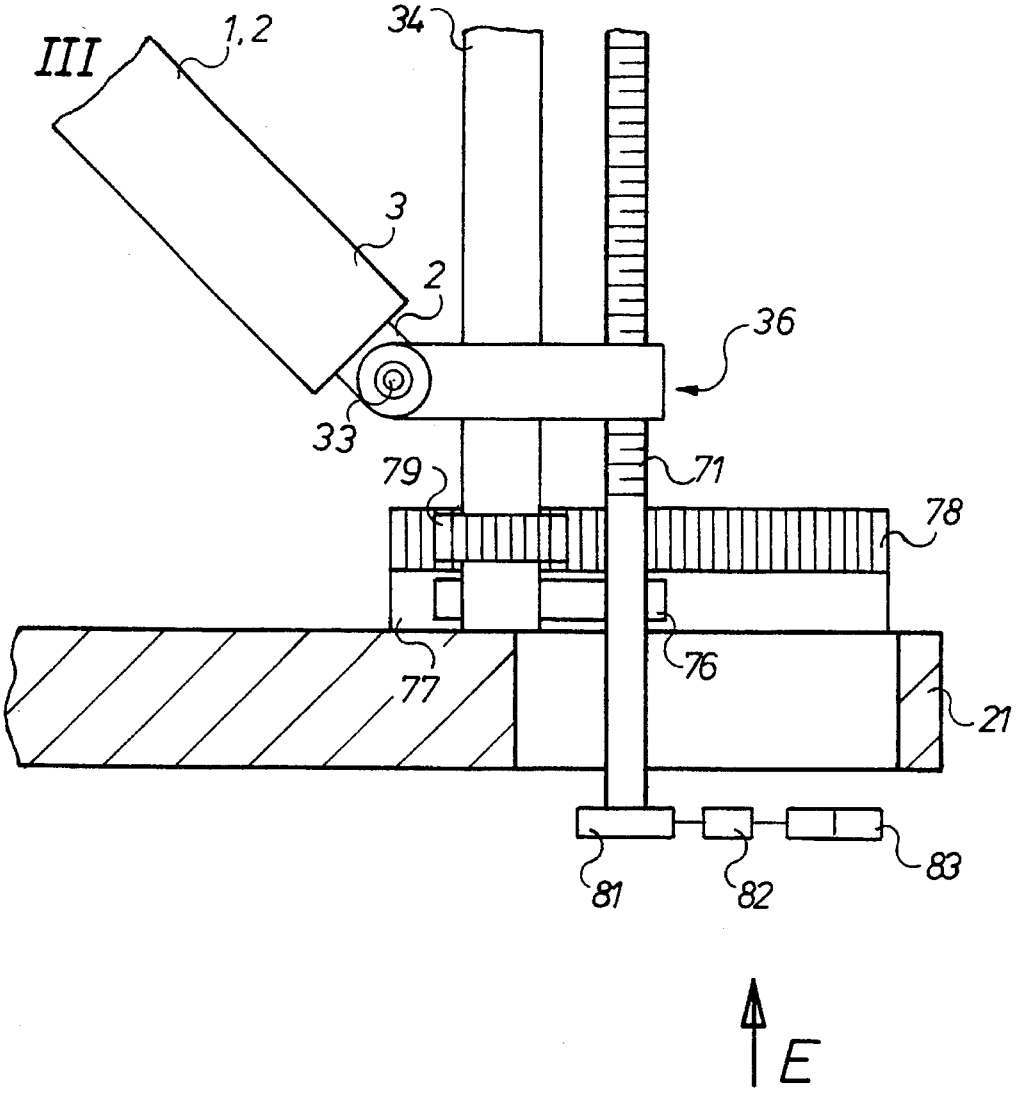
FIG. 6 is an enlarged top plan view of a portion of the adjustable turning bar of FIG. 4 as encircled at Z in FIG. 4.

In this case, the turning bar holders 42, 36 of the turning bar 1 are displaceably guided in a lower plane on support spindles 43, 34, and turning bar holders 59, 61 of the turning bar 58 are, in this case, guided on support spindles 62, 63 in a second, upper surface as seen in FIG. 5. All of the turning bar holders 36, 42; 59, 61 have separate threaded bores 64, 66, 67, 68, respectively, with each threaded bore receiving a threaded spindle 71, 72, 73, or 74 which, in turn, is powered by a suitable drive which is illustrated in FIG. 6. The support spindles 43 and 62 are respectively each fixedly seated at their ends in the side frames 9 and 21. The steps necessary to effect a change in the position of the turning bar 1 will now be described. It will be understood that the same procedure is usable with the second turning bar 58. The turning bar 1 is extended, as shown in FIG. 4, by the downward movement of the one turning bar holder 42 of the turning bar 1 on the support spindle 43 and the upward movement of the other turning bar holder 36 on the support spindle 34 and in this way arrives in the horizontal position II shown by dashed lines in FIG. 4. In the process, the support spindle 34 which is movably seated in the side frames 9, 21 is also brought into the position shown by dashed lines. Continued displacement of the turning bar holders 42, 36 in the previously mentioned directions, results in the turning bar 1 now taking up position I. In the course of this shifting of turning bar 1, the air openings facing the side frame 9 are opened and the air openings facing the side frame 21 are closed.

Figure 7:
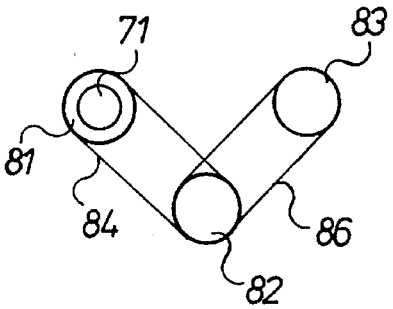
FIG. 7 is a schematic side elevation view of the enlarged portion of the adjustable turning bar of FIG. 6 and taken in the direction indicated by arrow E in FIG. 6.

FIGS. 6 and 7 show a suitable drive assembly for the longitudinally displaceable turning bar holder 36 of the turning bar 1 on the support spindle 34. The ends of the support spindles 34, 63 are seated in sliding blocks which, in turn, are displaceable in longitudinal guides fixed on the side frames. This is illustrated in FIG. 6 by the example of the support spindle 34, the end of which that is facing the side frame 21 is seated in a sliding block 76, which is displaceably secured in a longitudinal guide 77 disposed in a form-locking manner on the inside of the side frame 21. A toothed rack 78 is fastened on a side wall of the longitudinal guide 77 and extends over the entire length of the longitudinal guide 77 parallel to it. A gear wheel 79 is placed in a form-locking manner on the support spindle 34 and is in engagement with the toothed rack 78.

The threaded spindle 71 is in engagement with the threaded bore 68 of the turning bar holder 36. The end of the threaded spindle 71 facing the side frame 21 projects through a longitudinal slit in the side frame 21 and supports a toothed belt disk 81. The toothed belt disk 81 is connected via a toothed belt drive 82 exteriorly of the side frame 21, which compensates for shaft offset, with an electric motor 83 by means of toothed belts 84, 86.

A drive which is the same as the one shown in FIG. 6 is provided on the ends of the support spindle 63 and the threaded spindle 74 which are facing the side frame 21. The ends of the support spindle 34 and the threaded spindle 71 and of the support spindle 63 and the threaded spindle 74 facing the side frame 9 are respectively seated in longitudinal guides, as shown in FIG. 4, by means of displaceable sliding blocks.

The ends of the support spindles 43 and 62 as well as the ends of the threaded spindles 72 and 73 are each seated in a non-shiftable manner in the side frames 9, 21. The ends of the threaded spindles 72 and 73 facing the side frame 21 are each provided with a drive, for example an electric motor 75, as shown in FIG. 4.

If the turning bar 1 in accordance with the illustration in FIG. 4 is to be rearranged from position III through position II and into position I, i.e. turned by 90° in relation to its original position, the threaded spindles 71 and 72 are moved in a rotational direction via the associated gears (the gear 82 is shown) or electric motors (the stationary electric motor 83 is shown) in such a way that the turning bar holder 42 on the support spindle 43 is displaced in the direction of the side frame 21 and the turning bar holder 36 on the support spindle 34 is displaced in the direction of the side frame 9 until the position of the turning bar 1 in accordance with FIG. 4 has been attained. In the course of this shifting, the turning bar holder 36 describes a semi-circular curve 87 drawn in dashed lines in FIG. 4. The support spindles 34 or 63, which are guided on both ends by means of gear wheels 79 in toothed racks 78, are respectively synchronously displaced during the movement of the turning bar holders 36 or 61. The operation of the turning bar shifting assembly is also set forth in co-pending application Ser. No. 08/103,913, filed Aug. 10, 1993 and assigned to the assignor of the present application. This application is incorporated herein by reference.

Figure 14:
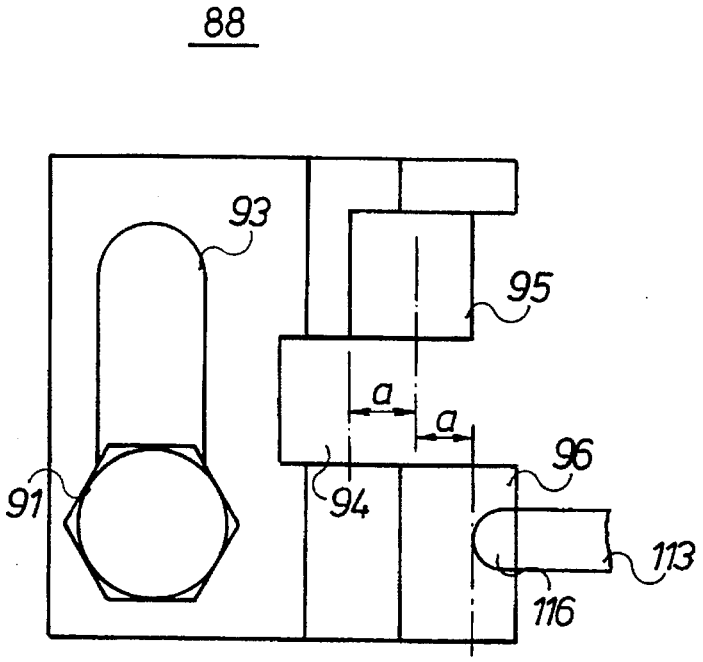
FIG. 14 is a bottom plan view of a central cam usable with the adjustable turning bar.
Figure 15:
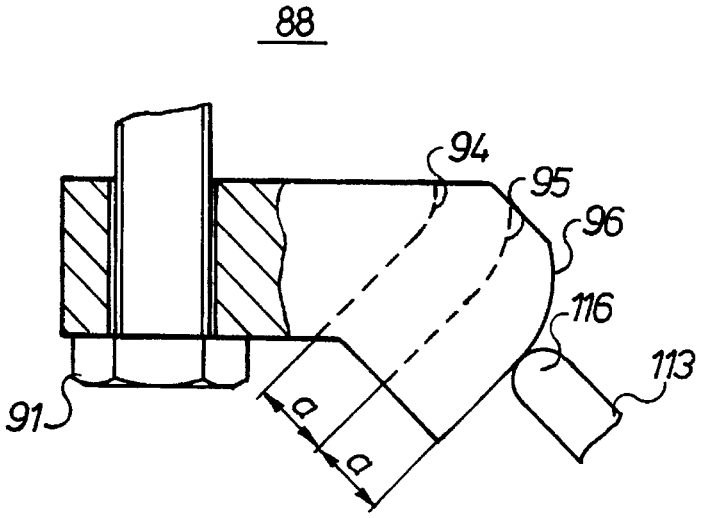
FIG. 15 is a side elevation view of the central cam of FIG. 14.

A second preferred embodiment of an adjustable turning bar assembly in accordance with the present invention is shown in the illustrations of FIG. 8 to FIG. 13. This turning bar corresponds to the turning bar 58 of FIG. 4. It is equipped with a turning bar holder, generally at 59, which is displaceable on the support spindle 62, and which is provided on one end with a swivel joint 41 and which is connected on the other end via a holder 32 and a swivel joint 33 with a turning bar holder 61 (not shown) which is displaceable on the support spindle 63. The position of the turning bar 58 is changeable in the same way as described in connection with the turning bar 1. In accordance with the illustrations in FIGS. 8 to 10, the turning bar 58 is shown in a position IV which extends at an angle $\alpha_1$ of 45° with respect to a horizontal line or to the position II shown in FIG. 4. In this case, the turning bar holder 59, which is embodied generally in the shape of a T, has, on its side facing the swivel joint 41 of the profiled part 44, control cams which are located on both sides, and which are indicated by 88 and 89. The control cam 88 is located on the side of the turning bar holder 59 facing the side frame 21 and is shown by itself and is also shown enlarged in FIGS. 14 and 15. The control cam 89 is located diametrically opposite the control cam 88. Both control cams 88 and 89 are displaceably disposed on the turning bar holder 59 parallel to each other and at right angles to an axis of rotation 92 of the support spindle 62. An elongated hole 93 is provided in each control cam 88 and 89 to effect this displacement. A screw 91 extends through each control cam 88 or 89 and can be fastened in the turning bar holder 59. Each control cam 88 or 89 has three curved control surfaces 94, 95, and 96, as seen most clearly in FIGS. 14 and 15, which extend parallel to each other and which are respectively distinguished from each other by a distance difference "a", for example 5 mm, for example in their lifting height. The turning bar 58 has a tube 2 which is like the tube 2 shown in FIG. 1 and which has the air openings 11 to 14 facing the side frame 9 and the air openings 16 to 19 facing the side frame 21. A cup-shaped slide 98 is located in the tube 2. The slide 98 has air openings 101, 102, 103, and 104 which in this embodiment are embodied in a slit-like manner, and each have a length of 2*a* and respectively correspond with the air openings 11, 12, 13, 14 facing the side frame 9. Similar slit-like air openings 106, 107, 108, and 109 having a length of 2*a* and disposed in the slide 98 and correspond with the air openings 16, 17, 18, and 19 of the tube 2 facing the side frame 21. The diameter of a circular air opening located in the tube 2 is maximally "a" which is approximately 5 mm, and is preferably a little less, for example "a"–"x" wherein "x" constitutes a safety margin for sealing the air openings located in the tube 2 and the slide 98. The amount "x" may be around 0.2 mm, for example. It is also possible to make the air openings 101 to 104 and 106 to 109 circular with a diameter of 2*a*.

Figures 8, 9, 10:
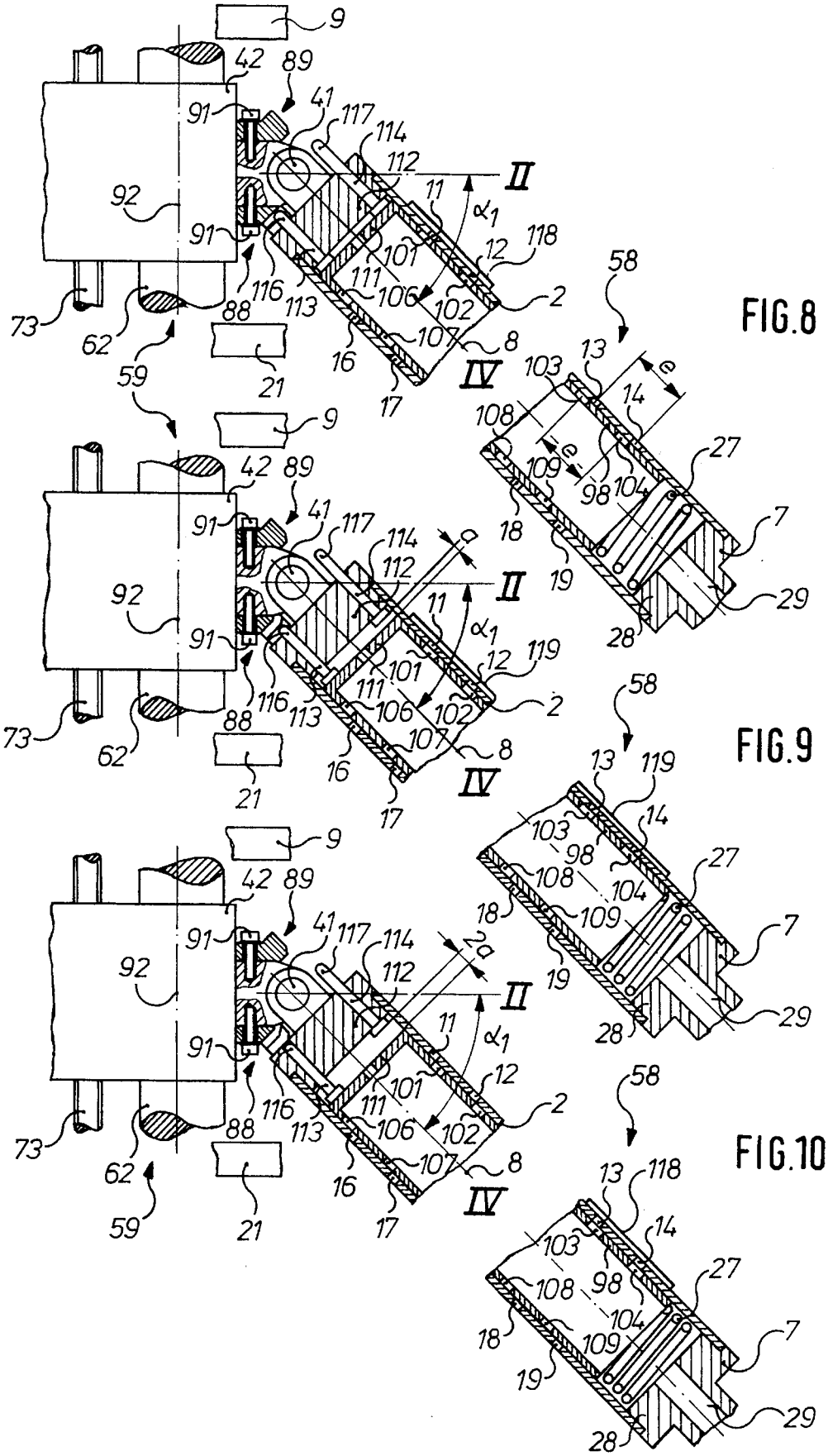
FIGS. 8–13 are a plurality of generally similar longitudinal section views of a second preferred embodiment of an adjustable turning bar in accordance with the present invention and showing different positions of the air outlet closing slide tube.

The bottom 111 of the cup-shaped slide 98, as seen, for example in FIG. 8, rests on a head end of a bolt 113 or 114, which is axially displaceable through an end piece 112 of the tube and which, has a rounded second end 116 or 117 that acts on one of the three control surfaces 94, 95 or 96 of the control cam 88 or 89 and which moves the slide 98 against the force of a compression spring 27 in the direction of the second end piece of the turning bar 58. It is shown in FIG. 8 that the bottom 111 of the slide 98 rests against the first or head end of the shorter bolt 113 of the two bolts 113 and 114, and that the second end 116 is in force-locking connection with the lowest control surface 94 of the control cam 88, so that the air openings 11, 101 and 12, 102 are aligned with each other and a paper web 118 of a width of a quarter web can be turned around this portion of the turning bar 58.

In FIG. 9 it is shown how the second end 116 of the shorter bolt 113 is in connection with the center control surface 95 of the control cam 88, so that the air openings 11, 101; 12, 102, mentioned in FIG. 8, as well as the air openings 13, 103 and 14, 104 are aligned with each other because the bolt 113 has displaced the slide 98 by an amount "a" in the axial direction, so that a paper web 119 of a width of half a web can be turned around this portion of the turning bar 58.

In FIG. 10 the second end 116 of the bolt 113 is in contact with the top control surface 96 of the control cam 88, so that only the air openings 13, 103 and 14, 104 are aligned with each other, so that a paper web 118 of a width of a quarter web can be turned at this area of the turning bar 58. Here, the lift length of the bolt 113 travelled equals 2*a*. The selection of the control surfaces 94, 95 or 96 to be engaged by the second end 116 of the bolt 113 is accomplished by loosening the screw 91 and by displacing the control cam 88 in the area of the elongated hole 93, as shown most clearly in FIG. 14. The distance "e" between the center lines of two hole-shaped air openings 13 and 14 disposed in the tube 2, as shown in FIG. 8, is equal to the distance between two slit-like air openings 103 and 104 disposed on the slide 98. The distance between the two (shown in dash-dotted lines) slit-like air openings 107–108 and 102–103, disposed respectively adjacent to each other from the center of the turning bar is shorter by the amount "a" in comparison with the other distances between the respectively adjacently disposed slit-like openings 106–107 and 101–102.

Figures 11, 12, 13:
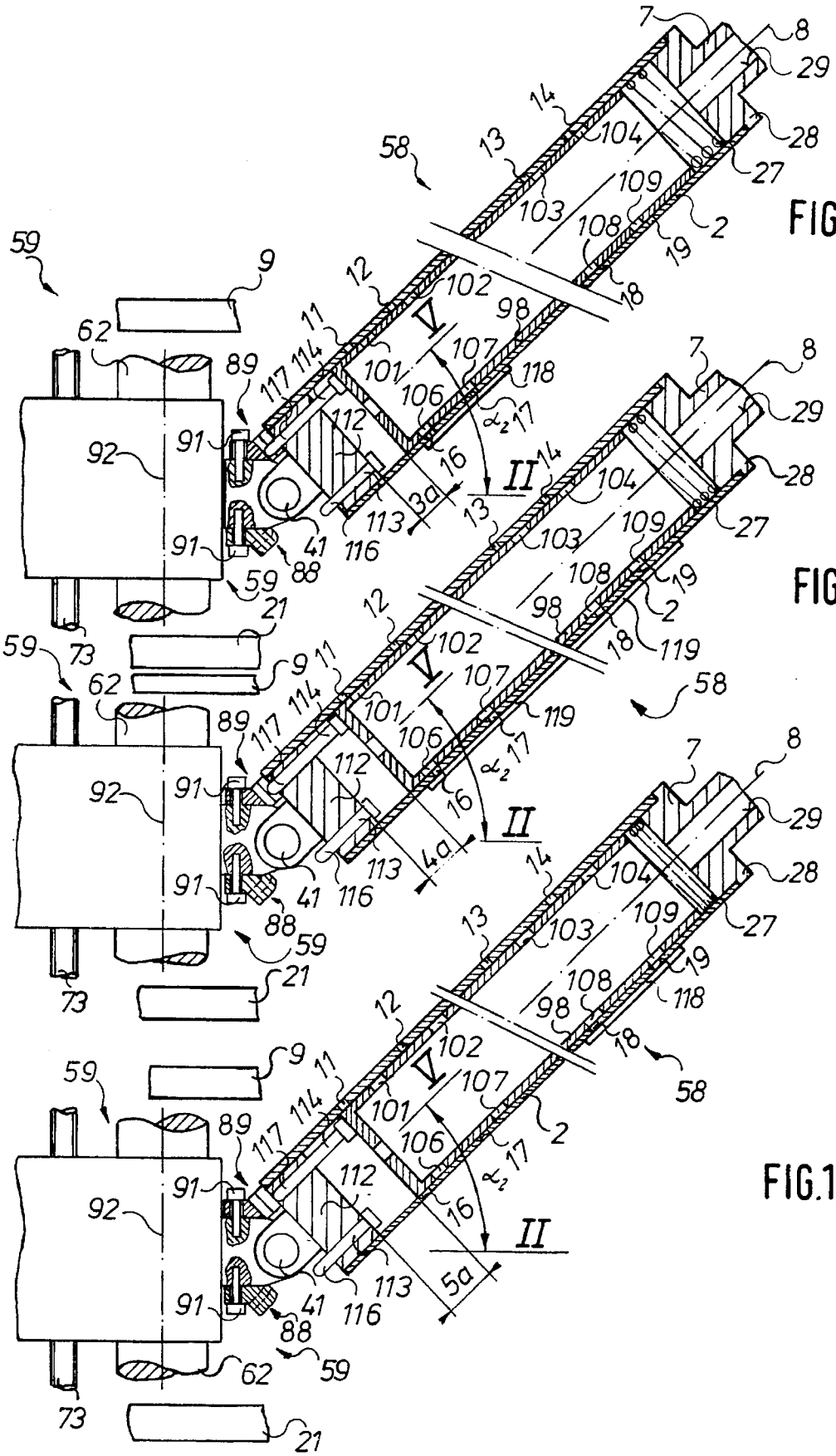

When changing the position of the turning bar 58 over an angle $\alpha_2$ of 45° in relation to a horizontal or extended position II in accordance with the illustration in FIGS. 11 to 13, the second end 117 of the longer bolt 114 now engages the control surfaces 94, 95 or 96 of the control cam 87 so that the slide 98 is displaced against the force of the spring 27 by an amount 3*a* (FIG. 11), 4*a* (FIG. 12) or 5*a* (FIG. 13). In this way, it is possible to turn a paper web 118 of one quarter the width of the web around the turning bar 58 respectively to the left or the right on the side 58 facing the side frame 21, or a paper web 119 of one-half of the width of the web altogether, in the course of this web turning, air flows out between the paper web 118 or 119 and the turning bar 58, while the air openings which are not being used are closed. The following air openings of the turning bar 58 of FIGS. 11 to 13 are opened toward each other: in FIG. 11 the air openings 16, 106; and 17, 107 for turning a paper web 118 of one quarter the width of a web on the left side of the turning bar 58; in FIG. 12 also the air openings 18, 108 and 19, 109, in addition to the air openings mentioned in FIG. 11, for turning a paper web 119 of one-half the width of a web on the entire width of the side of the turning bar 58 facing the side frame 21; in FIG. 13 only the air opening 18, 108 and 19, 109, last-mentioned in FIG. 12, on the right side of the turning bar 58. All air openings not mentioned above remain closed, so that the compressed air only flows out through the required air openings and is blown against the paper web.

Figure 16:
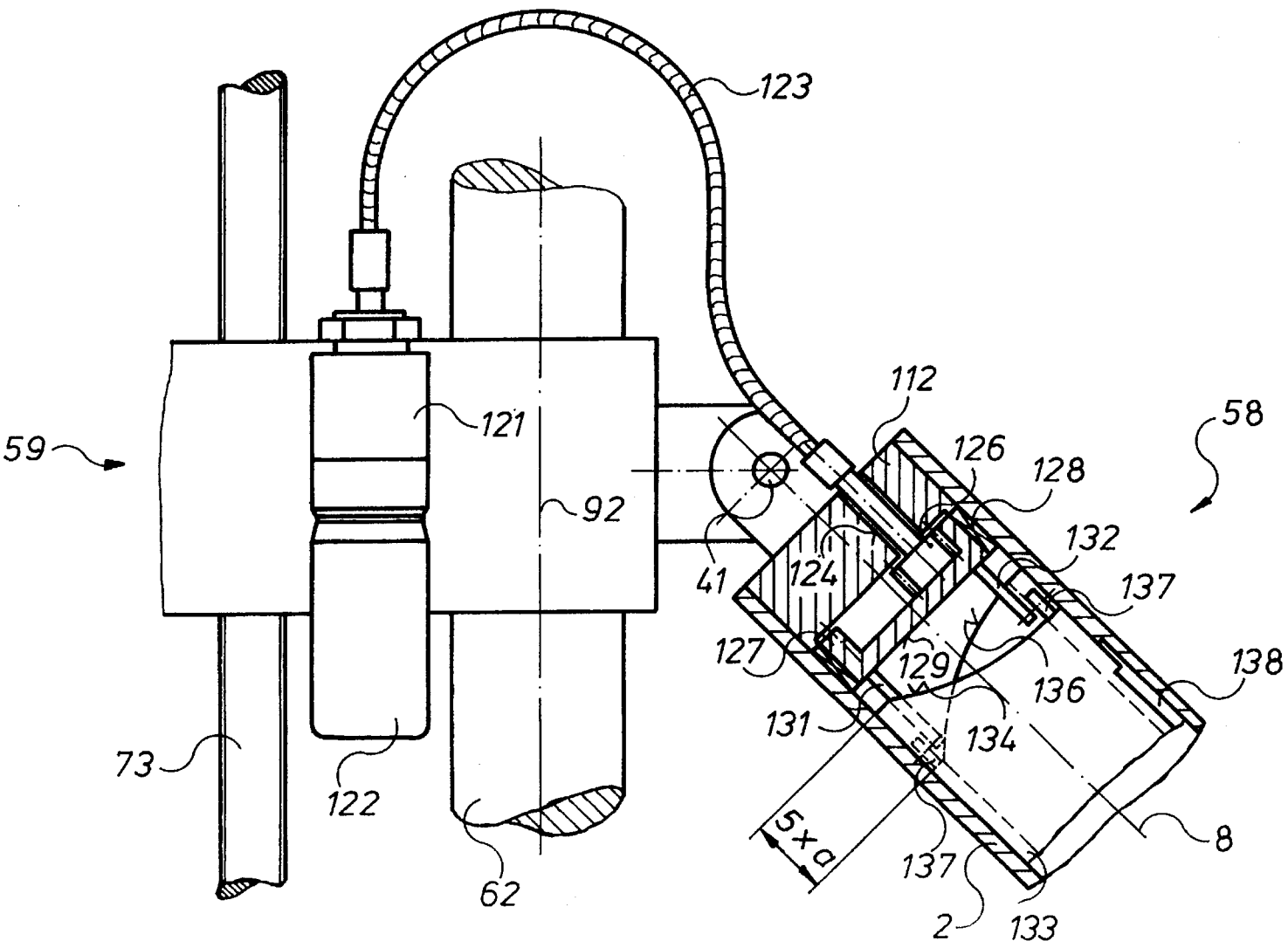
FIG. 16 is a depiction of a joint end of a third preferred embodiment, partly in cross-section, of an adjustable turning bar in accordance with the present invention.

It is also possible to generate the lift or shifting movement of the cup-shaped slide 98 by electrical control means instead of control cam 88 or 89, each with several control surfaces 94, 95 and 96. In connection with this, a side view of a third preferred embodiment of a drive for closing the air openings is illustrated in FIG. 16. In this third embodiment, the turning bar 58 is in the same position as that shown in FIGS. 8 to 10. A turning bar holder 59 is slidingly disposed on a support spindle 62 and, by means of a threaded spindle 73 extending parallel to it, can be displaced in the axial direction of the spindles 62 or 73. A motor 121, for example an electric motor with electrical connections not shown in detail, is fastened on or included with the turning bar holder 59. Its actual rotational position, and thus the position of the drive, can be determined by means of a potentiometer 122. The electric motor 121 is connected in a force-locking and form-locking manner, by way of a flexible drive shaft 123 that passes through a bore 124 in the end piece 112 of the turning bar 58, with a gear wheel 126, which meshes with an inner gear wheel 127. The inner gear wheel 127 is securely connected to an inner ring of a needle roller bearing 128. The outer ring of the needle roller bearing 128 is connected in a force-locking and form-locking manner with the inner surface of the tube 2 of the turning bar 58, so that the inner gear wheel 127 is also rotatably seated. On an outer bottom side 129 of the inner gear wheel 127, which is facing away from the turning bar holder 59, and which is cup-shaped in diameter, two bolts 131 and 132, with rollers 137 or cams, which are in operational engagement with radial cams 134 and 136 formed on the front of a tube-shaped slide 133, extend parallel to the axis of rotation 8 of the turning bar 58 and are disposed diametrically on the circumference of the bottom side 129. The radial cams 134 and 136 respectively extend from 0° to 180° or from 180° to 360° and are evenly disposed with respect to each other, i.e. they have the same gradient. By means of the motorized turning of the inner gear wheel 127 with the rollers 137 disposed on the outer bottom side 129 on the bolts 131, 132 of maximally 180°, the slide 133 can be moved maximally five times "a" in the direction of its axis of rotation 8, i.e. by five times the diameter of an air opening in the direction of the spring 27, not shown in FIG. 16. In this way it is possible, in correspondence with the position of the rotational angle of the inner gear wheel 127 in the range between 0° and 180°, to perform an axial displacement of the air openings by from zero to five times the amount "a", in that the ends of the bolts 131 and 132 perform a rotating movement and in the course of this move along the evenly rising cams 134 and 136. In this way a selectable closing of the unneeded air openings takes place in accordance with the illustrations in FIGS. 8 to 13. To prevent turning of the slide 133 in relation to the tube 2, a feather key 138 is disposed between the parts. In place of the described electrically operated control means it is also possible to employ known pneumatically or hydraulically operated control means.

While preferred embodiments of an adjustable turning bar in accordance with the present invention have been set forth fully and completely hereinabove, it will be understood that a number of changes in, for example, the source of supply for the compressed air, the type of electric drive motors used for the spindles, the type of drive belts used for the spindles and the like could be made without departing from the true spirit and scope of the present invention which is accordingly to be limited only by the following claims.

What is claimed is:

1. An adjustable turning bar assembly which is usable to turn an elongated material web, said adjustable turning bar assembly comprising:

an elongated turning bar tube having first and second ends and having a plurality of air openings spaced along a peripheral surface of said tube intermediate said ends;

an adjustable support for at least one of said first and second ends of said turning bar tube, said adjustable support being usable to shift said adjustable turning bar with respect to spaced side frames;

a compressed air feed port in one of said first and second ends of said turning bar tube for use in supplying air under pressure to an interior of said turning bar tube;

a tubular slide positioned in said interior of said turning bar tube and having air outlets which are selectively alignable with said air openings in said turning bar tube; and a slide shifting assembly operable automatically in response to a shifting of said turning bar tube to shift said slide axially in said turning bar tube during said shifting of said turning bar tube to vary the selected ones of said air outlets of said slide aligned with said air openings of said turning bar tube, said slide shifting assembly thereby shifting said tubular slide axially in said turning bar tube during shifting of said turning bar tube with respect to said side frames.

2. An adjustable turning bar assembly which is usable to turn an elongated material web, said adjustable turning bar assembly comprising:

an elongated turning bar tube having first and second ends and having a plurality of air openings spaced along a peripheral surface of said tube intermediate said ends;

an adjustable support for at least one of said first and second ends of said turning bar tube, said adjustable support being usable to shift said adjustable turning bar with respect to spaced side frames;

a compressed air feed port in one of said first and second ends of said turning bar tube for use in supplying air under pressure to an interior of said turning bar tube;

a tubular slide positioned in said interior of said turning bar tube and having air outlets which are selectively alignable with said air openings in said turning bar tube; and a slide shifting assembly operable automatically in response to shifting of said turning bar tube to shift said slide axially in said turning bar tube to shift said slide axially in said turning bar tube to vary the selected ones of said air outlets of said slide aligned with said air openings of said turning bar tube, said slide shifting assembly including at least a first cam secured to one of said adjustable supports and at least a first cam follower secured to said tubular slide and engageable with said cam to shift said slide axially in response to shifting of said turning bar tube.

3. The adjustable turning bar assembly of claim 2 further including a second cam secured on one of said adjustable supports, and a second cam follower secured to said tubular slide.

4. The adjustable turning bar assembly of claim 3 wherein each of said first and second cams has several control surfaces.

5. The adjustable turning bar assembly of claim 2 wherein the number of said air openings in said turning bar corresponds to the number of air outlets in said tubular slide.

6. The adjustable turning bar of claim 2 wherein each of said air outlets in said tubular slide and each of said air openings in said turning bar tube have corresponding diameters.

* * * * *